US005653619A

United States Patent [19]

Cloud et al.

[11] Patent Number: 5,653,619

[45] Date of Patent: Aug. 5, 1997

[54] METHOD TO FORM SELF-ALIGNED GATE STRUCTURES AND FOCUS RINGS

[75] Inventors: Eugene H. Cloud; Trung T. Doan; Tyler A. Lowrey; David A. Cathey; J. Brett Rolfson, all of Boise, Id.

[73] Assignee: Micron Technology, Inc., Boise, Id.

[21] Appl. No.: 300,985

[22] Filed: Sep. 6, 1994

Related U.S. Application Data

[63] Continuation of Ser. No. 36,751, Mar. 25, 1993, abandoned, which is a continuation-in-part of Ser. No. 977,477, Nov. 17, 1992, Pat. No. 5,259,799, which is a continuation of Ser. No. 844,369, Mar. 2, 1992, Pat. No. 5,186,670.

[51] Int. Cl.[6] ..... H01J 9/02; H01J 1/30

[52] U.S. Cl. ..... 445/24; 445/49; 445/50

[58] Field of Search ..... 445/24, 49, 50

[56] References Cited

U.S. PATENT DOCUMENTS

| | | | |
|---|---|---|---|
| 4,663,559 | 5/1987 | Christensen | 313/336 |
| 4,671,851 | 6/1987 | Beyer et al. | 156/645 |
| 4,943,343 | 7/1990 | Bardai et al. | 156/643 |
| 5,012,153 | 4/1991 | Atkinson et al. | 313/336 |
| 5,055,158 | 10/1991 | Gallagher et al. | 156/643 |
| 5,191,217 | 3/1993 | Kane et al. | 313/309 |
| 5,229,331 | 7/1993 | Doan et al. | 313/309 |
| 5,378,182 | 1/1995 | Liu | 445/50 |

FOREIGN PATENT DOCUMENTS

| | | |
|---|---|---|
| 49-122269 | 11/1974 | Japan . |
| 51-21471 | 2/1976 | Japan . |
| 52-119164 | 10/1977 | Japan . |
| 1-128332 | 5/1989 | Japan . |
| 3-22329 | 1/1991 | Japan . |
| 3-194829 | 8/1991 | Japan . |

*Primary Examiner*—P. Austin Bradley
*Assistant Examiner*—Jeffrey T. Knapp
*Attorney, Agent, or Firm*—Fletcher & Associates

[57] ABSTRACT

A selective etching and chemical mechanical planarization process is employed for the formation of self-aligned gate and focus ring structures surrounding an electron emission tip for use in field emission displays. The process is employed to construct an emission grid whereby the gate structure is capable of producing a field strength at the cathode tip sufficient to generate electron emission. The gate is disposed at a location above the tip such that the gate physically intercepts the outermost lateral portions of the beam, yet does not induce a significant electrostatic outward divergence of the beam, thereby reducing the cross-section of the beam.

15 Claims, 11 Drawing Sheets

METHOD TO FORM SELF-ALIGNED GATE STRUCTURES AND FOCUS RINGS

CROSS-REFERENCE TO RELATED APPLICATIONS

This is a continuation of application Ser. No. 08/036,751 filed on Mar. 25, 1993 and now abandoned; which is a continuation in part application of U.S. application Ser. No. 07/977,477, filed on Nov. 17, 1992, and issued as U.S. Pat. No. 5,259,799; which is a continuation of U.S. patent application Ser. No. 07/844,369 filed Mar. 2, 1992, and issued as U.S. Pat. No. 5,186,670.

FIELD OF THE INVENTION

This invention relates to field emission devices, and more particularly to producing high resolution electron beams from field emission devices through the use of an extraction grid which physically reduces the diameter of the electron beam.

BACKGROUND OF THE INVENTION

Cathode ray tube (CRT) displays, such as those commonly used in desk-top computer screens, function as a result of a scanning electron beam from an electron gun, impinging on phosphors on a relatively distant screen. The electrons increase the energy level of the phosphors. When the phosphors return to their normal energy level, they release the energy from the electrons as a photon of light, which is transmitted through the glass screen of the display to the viewer.

Flat panel displays have become increasingly important in appliances requiring lightweight portable screens. Currently, such screens use electroluminescent or liquid crystal technology. A promising technology is the use of a matrix-addressable array of cold cathode emission devices to excite phosphor on a screen.

In U.S. Pat. No. 3,875,442, entitled "Display Panel," Wasa. et al. disclose a display panel comprising a transparent gas-tight envelope, two main planar electrodes which are arranged within the gas-tight envelope parallel with each other, and a cathodoluminescent panel. One of the two main electrodes is a cold cathode, and the other is a low potential anode, gate, or grid. The cathode luminescent panel may consist of a transparent glass plate, a transparent electrode formed on the transparent glass plate, and a phosphor layer coated on the transparent electrode. The phosphor layer is made of, for example, zinc oxide which can be excited with low energy electrons.

Spindt, et al. discuss field emission cathode structures in U.S. Pat. Nos. 3,665,241; and 3,755,704; and 3,812,559; and 4,874,981. To produce the desired field emission, a potential source is provided with its positive terminal connected to the gate, or grid, and its negative terminal connected to the emitter electrode (cathode conductor substrate). The potential source may be made variable for the purpose of controlling the electron emission current. Upon application of a potential between the electrodes, an electric field is established between the emitter tips and the low potential anode grid, thus causing electrons to be emitted from the cathode tips through the holes in the grid electrode. This structure is depicted in FIG. 1.

An array of points in registry with holes in low potential anode grids are adaptable to the production of cathodes subdivided into areas containing one or more tips, from which areas emissions can be drawn separately by the application of the appropriate potentials thereto.

The clarity, or resolution, of a field emission display is a function of a number of factors, including emitter tip sharpness, alignment and spacing of the gates (or grid openings) which surround the tips, pixel size, as well as cathode-to-gate and cathode-to-screen voltages. These factors are also interrelated. Another factor which effects image sharpness is the angle at which the emitted electrons strike the phosphors of the display screen.

The distance (d) that the emitted electrons must travel from the baseplate to the faceplate is typically on the order of several hundred microns. The contrast and brightness of the display are optimized when the emitted electrons impinge on the phosphors located on the cathodoluminescent screen, or faceplate, at a substantially 90° angle.

Cold cathode field emission structures provide an electron beam which diverges, i.e., significantly in cross-sectional area, as the beam travels towards the anode. This is not desirable, particularly when the application is a high resolution flat panel display, since the "spot size" at the anode will limit the attainable resolution of the display.

The contrast and brightness of the display are not currently optimized due to the fact that the initial electron trajectories assume a substantially conical pattern having an apex angle of roughly 30°, which emanates from the emitter tip. Space-charge effects result in coulombic repulsion among emitted electrons which tends to further promote dispersion within the electron beam. However, the bulk of the beam spread in a conventional "tight gap" field emission display is a result of the initial lateral component imposed on the beam from the extraction grid, and not from coulombic self-repulsion of the beam itself. FIG. 1 illustrates the dispersion of an unfocused electron beam.

U.S. Pat. No. 5,070,282 entitled, "An Electron Source of the Field Emission Type," discloses a "controlling electrode" placed downstream of the "extracting electrode." U.S. Pat. No. 4,943,343 entitled, "Self-aligned Gate Process for Fabricating Field Emitter Arrays," discloses the use of photoresist in the formation of self-aligned gate structures.

SUMMARY OF THE INVENTION

The object of the present invention is to enhance image clarity on flat panel displays through the use of self-aligned gate and focus ring structures in the fabrication of cold cathode emitter devices.

Using the process of the present invention, it is possible to construct an emission device whereby the gate structure is capable of producing a field strength at the cathode tip sufficient to generate electron emission. The top portion of the gate is disposed at a location above the tip such that the gate physically intercepts the outermost lateral portions of the beam, yet does not induce a significant electrostatic outward divergence of the beam, thereby reducing the cross-section of the beam, as seen in FIGS. 2, 2A, and 2B.

The focus ring(s) of the present invention, which are similar to the focusing structures of CRTs, function to collimate the emitted electrons so that the beam impinges on a smaller spot on the display screen, as seen in FIGS. 2, 2A, and 2B.

One advantage of the present invention is that it allows for the incorporation of focusing structures which enhance collimation of electrons emitted from the cathode emitter tips, and result in improved display contrast and clarity.

Another advantage of the present invention is the fabrication of the focusing structures is accomplished in a self-aligned manner, which greatly reduces process variability, and decreases manufacturing costs.

BRIEF DESCRIPTION OF THE DRAWINGS

The present invention will be better understood by reading the following description of nonlimitative embodiments, with reference to the attached drawings, wherein like parts in each of the several figures are identified by the same reference character, and which are briefly described as follows.

DETAILED DESCRIPTION OF THE INVENTION

Figure 1:
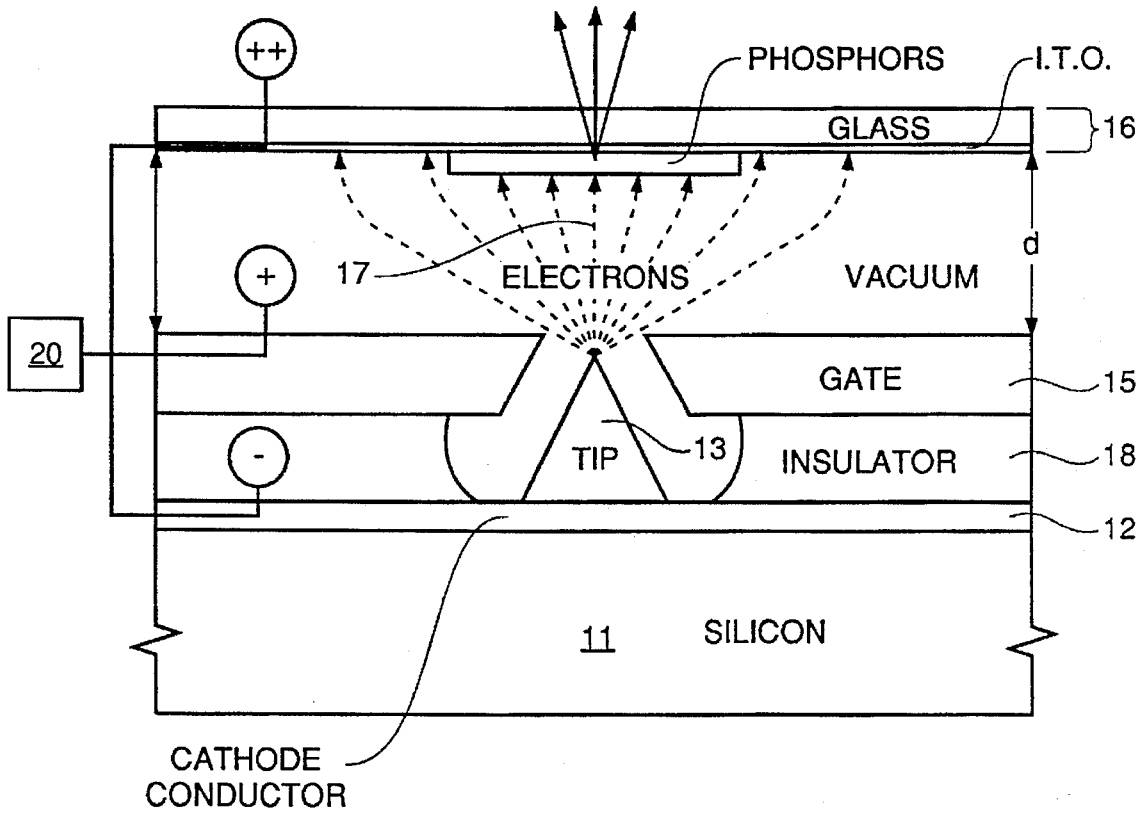
FIG. 1 is a cross-sectional schematic drawing of a flat panel display showing a field emission cathode which lacks the self-aligned focus rings of the present invention.

Referring to FIG. 1, a field emission display employing a cold cathode is depicted. The substrate 11 can be comprised of glass, for example, or any of a variety of other suitable materials. In the preferred embodiment, a single crystal silicon layer serves as a substrate 11 onto which a conductive material layer 12, such as doped polycrystalline silicon, has been deposited.

At a field emission site location, a micro-cathode 13 (also referred to herein as an emitter tip) has been constructed on top of the substrate 11. The micro-cathode 13 is a protuberance which may have a variety of shapes, such as pyramidal, conical, or other geometry which has a fine micro-point for the emission of electrons. Surrounding the micro-cathode 13, is a low potential anode gate structure 15.

When a voltage differential, through source 20, is applied between the cathode 13 and the gate 15, an electron stream 17 is emitted toward a phosphor coated screen 16. The screen 16 functions as the anode. The electron stream 17 tends to be divergent, becoming wider at greater distances from the tip of cathode 13.

The electron emission tip 13 is integral with the semiconductor substrate 11, and serves as a cathode conductor. Gate 15 serves as a low potential anode or grid structure for its respective cathode 13. A dielectric insulating layer 18 is deposited on the conductive cathode layer 12. The insulator 18 also has an opening at the field emission site location.

Figure 2:
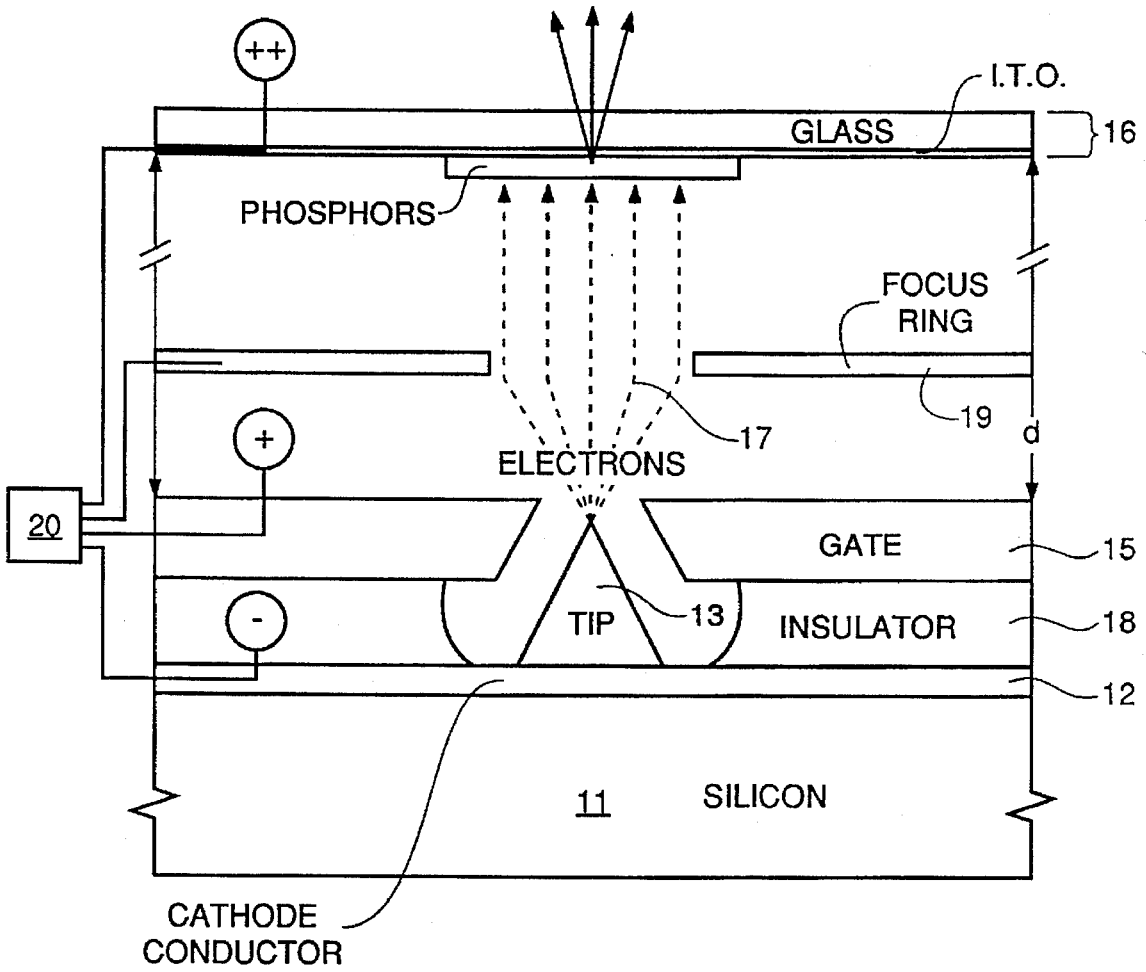
FIG. 2 is the flat panel display shown in FIG. 1, further depicting the added focus ring structures of the present invention.
Figure 2A:
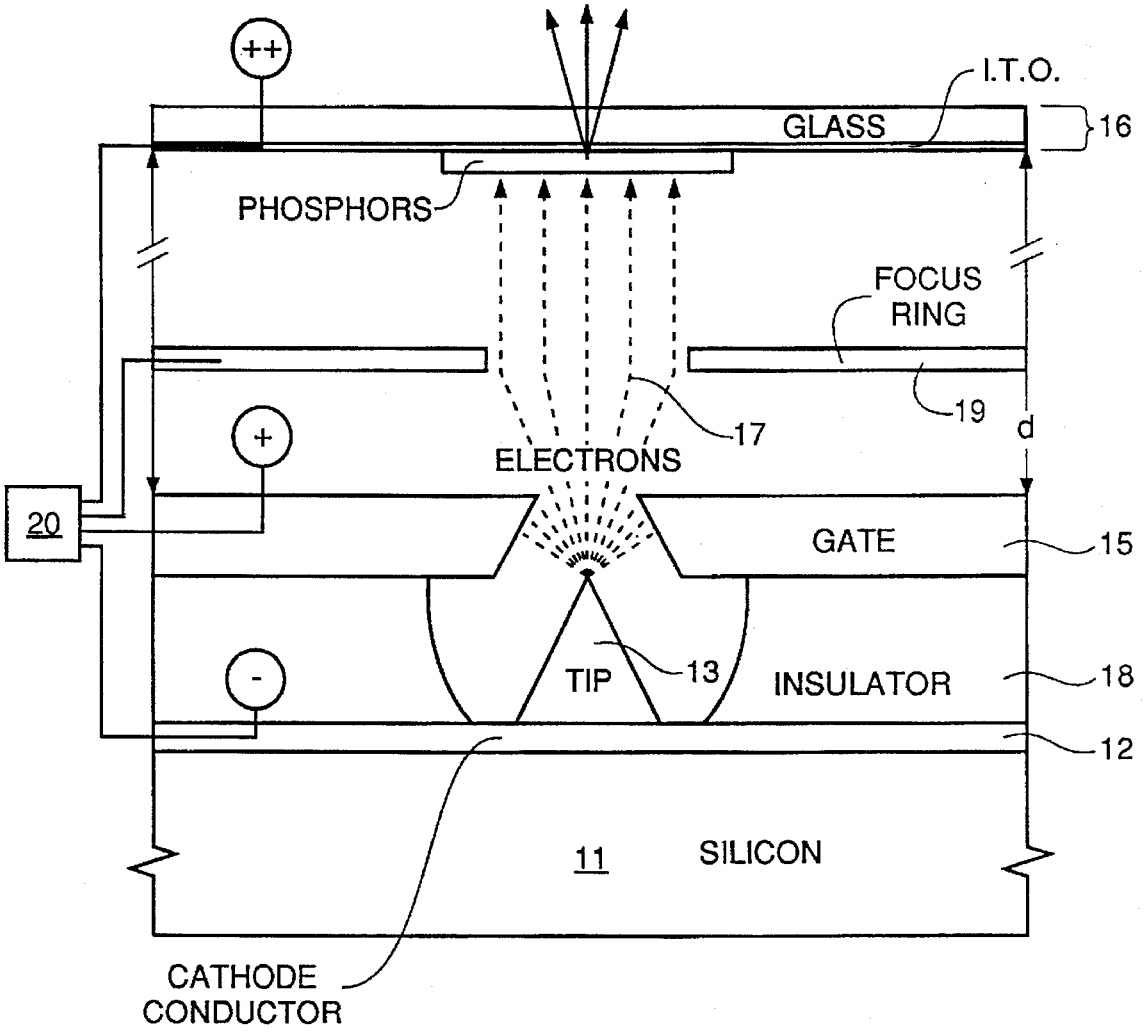
FIG. 2A is an alternative embodiment of the flat panel display of FIG. 2, further showing an emission device whereby the top portion of the gate is disposed at a location above the tip such that the gate physically intercepts the outermost lateral portions of the beam, yet does not induce a significant electrostatic outward divergence of the beam, thereby reducing the cross-section of the beam, according to the present invention.

The cathode structure of FIGS. 2 and 2A are similar to FIG. 1. However, beam collimating focus ring structures 19 fabricated by the process of the present invention, are also depicted. The focus rings 19 collimate the electron beam 17 emitted from each emitter 13 so as to reduce the area of the spot where the beam impinges on the phosphor coated screen 16, thereby improving image resolution.

Figure 2B:
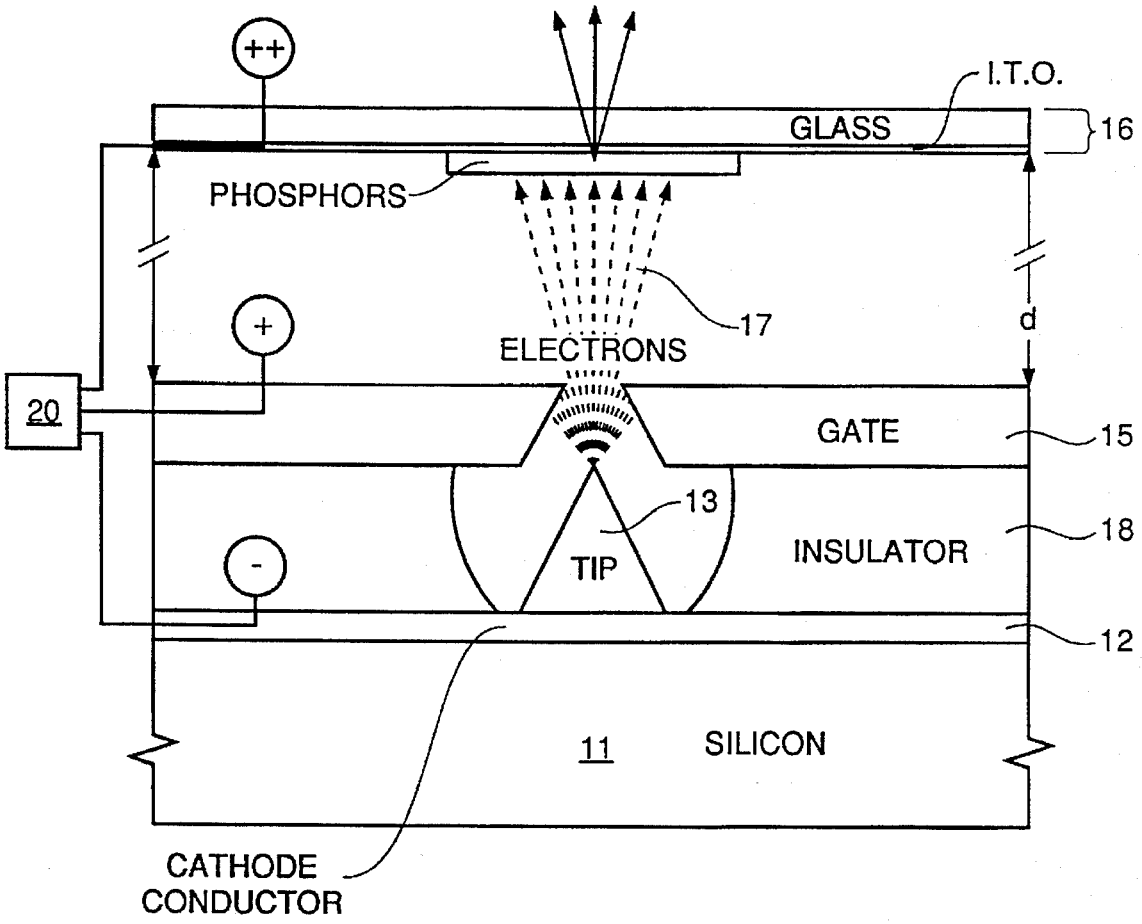
FIG. 2B is an alternative embodiment of the flat panel display of FIG. 2A in which the gate structure also functions to focus the electron beam without the aid of the focus ring structure.

In the alternative embodiment of FIG. 2B, the focus ring structure 19 is eliminated altogether, and the gate 15 (as a result of its location) functions both to pull the electrons from the tip 13 and to collimate the electrons once they have been emitted.

FIGS. 2A and 2B depict an emission device whereby the top portion of the gate is disposed at a location above the tip such that the gate physically intercepts the outermost lateral portions of the beam, yet does not induce a significant electrostatic outward divergence of the beam, thereby reducing the cross-section of the beam.

The invention can best be understood with reference to FIGS. 3–8 of the drawings which depict the initial, intermediate and final structures produced by a series of manufacturing steps according to the invention.

There are several methods by which to form the electron emission tips 13 (Step A of FIG. 8) employed in the process of the present invention. Examples of such methods are presented in U.S. Pat. No. 3,970,887 entitled, "Microstructure Field Emission Electron Source."

In practice, a P-type silicon wafer having formed therein (by suitable known doping pretreatment) a series of elongated, parallel extending opposite N-type conductivity regions, or wells. Each N-type conductivity strip has a width of approximately 10 microns, and a depth of approximately 3 microns. The spacing of the strips is arbitrary and can be adjusted to accommodate a desired number of field emission cathode sites to be formed on a given size silicon wafer substrate 11.

Processing of the substrate to provide the P-type and N-type conductivity regions may be by any well-known semiconductor processing techniques, such as diffusion and/or epitaxial growth. If desired, the P-type and N-type regions, of course, can be reversed through the use of a suitable starting substrate 11 and appropriate dopants.

The wells, having been implanted with ions will be the site of the emitter tips 13. A field emission cathode microstructure 13 can be manufactured using semiconductor substrate 11. The semiconductor substrate 11 may be either P or N-type and is selectively masked on one of its surfaces where it is desired to form field emission cathode sites. The masking is done in a manner such that the masked areas define islands on the surface of the underlying semiconductor substrate 11. Thereafter, selective sidewise removal of the underlying peripheral surrounding regions of the semiconductor substrate 11 beneath the edges of the masked island areas results in the production of a centrally disposed, raised, semiconductor field emitter tip 13 in the region immediately under each masked island area defining a field emission cathode site.

It is preferred that the removal of underlying peripheral surrounding regions of the semiconductor substrate 11 be closely controlled by oxidation of the surface of the semiconductor substrate 11 surrounding the masked island areas with the oxidation phase being conducted sufficiently long to produce sideways growth of the resulting oxide layer beneath the peripheral edges of the masked areas to an extent required to leave only a non-oxidized tip 13 of underlying substrate 11 beneath the island mask.

Thereafter, the oxide layer is differentially etched away at least in the regions immediately surrounding the masked island areas to result in the production of a centrally disposed, raised, semiconductor field emitter tip 13 integral with the underlying semiconductor substrate 11 at each desired field emission cathode site.

The embodiments of FIGS. 2, 2A, and 2B are manufactured using substantially the same method. However, there are some variations which will be pointed out.

Figure 8:
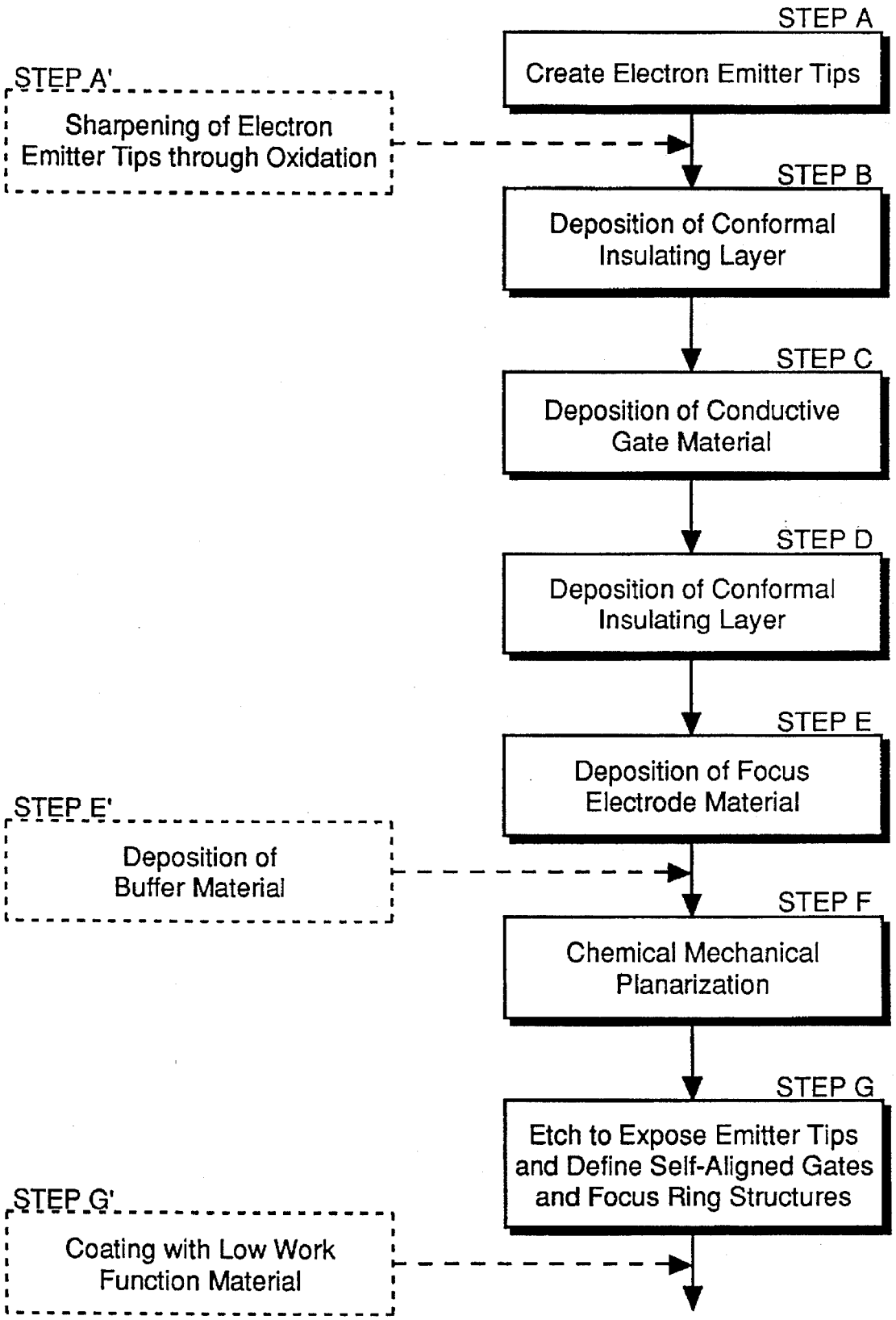
FIG. 8 is a flow diagram of the steps involved in the formation of self-aligned gate and focus ring structures according to the present invention.

Before beginning the gate formation process, the tip 13 of the electron emitter may be sharpened through an oxidation process (Step A' of FIG. 8). The surface of the silicon wafer (Si) 11 and the emitter tip 13 are oxidized to produce an oxide layer of $SiO_2$ (not shown), which is then etched to sharpen the tip 13. Any conventional, known oxidation process may be employed in forming the $SiO_2$, and etching the tip 13.

The next step (Step B of FIG. 8) is the deposition of a insulating material 18 which is selectively etchable with respect to the conductive gate material 15. In the preferred embodiment, a silicon dioxide layer 18 is used. Other suitable selectively etchable materials, including but not limited to, silicon nitride and silicon oxynitride may also be used.

The thickness of this first insulating layer 18 will substantially determine both the gate 15 to cathode 13 spacing, as well as the gate 15 to substrate spacing 11. Hence, the insulating layer 18 must be as thin as possible, since small gate 15 to cathode 13 distances result in lower emitter drive voltages, at the same time, the insulating layer 18 must be large enough to prevent the oxide breakdown which occurs if the gate is not adequately spaced from the cathode conductor 12.

The insulating layer 18 can be deposited to a level slightly below the tip 13, as in FIG. 2. Alternatively, the insulating layer 18 can be deposited to a level substantially equal to or slightly higher than the level of the cathode emitter 13, as shown in FIGS. 2A and 2B. The height of the insulating layer 18 is one factor which will directly effect the distance between the top of the gate 15 and the emitter 13. Other factors include the depth of the conductive layer 15 and the level to which the layers are planarized, discussed below, as seen in FIG. 3B.

Figure 3:
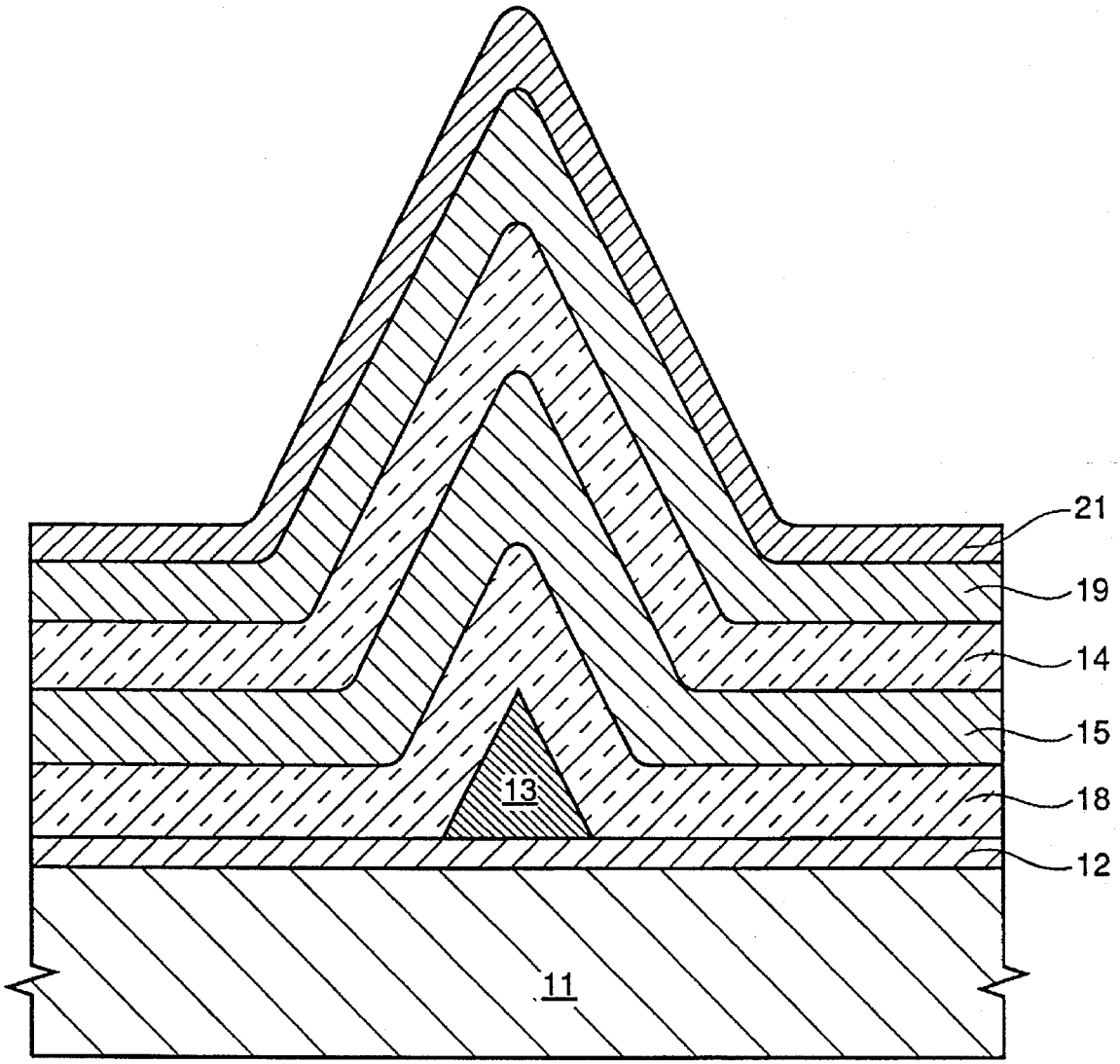
FIG. 3 shows a field emission cathode, having an emitter tip, on which has been deposited a first insulating layer, a conductive layer, a second insulating layer, a focus electrode layer, and a buffer layer according to the present invention.

The oxide insulating layer 18, as shown in FIG. 3, is preferably a conformal insulating layer. The oxide is deposited on the emitter tip 13 in a manner such that the oxide layer 18 conforms to the shape of the cathode emitter tip 13.

The next step in the process (Step C of FIG. 8) is the deposition of the conductive gate material 15 (FIG. 3). The gate 15 is formed from a conductive layer 15. The conductive material layer 15 may comprise a metal, such as chromium or molybdenum, but the preferred material for this process is deemed to be doped polysilicon or silicided polysilicon.

To manufacture the embodiments of FIGS. 2A and 2B, the conductive gate material 15 will be deposited at a level substantially equal to or slightly greater than the level of the emitter tip 13. In the embodiments of FIGS. 2A and 2B, the gate structure 15, by its placement in relation to the cathode emitter, also functions as a collimating structure. Hence, the physical and electrical properties of the gate 15 are used to generate an electron stream having a reduced cross-sectional area to the anode screen 16.

At this stage in the fabrication (Step D of FIG. 8), a second insulating layer 14 is deposited (FIG. 3). The second insulating layer 14 is substantially similar to the first insulating layer 18, e.g., layer 14 is also preferably conformal in nature. The second insulating layer 14 may also comprise silicon dioxide, silicon nitride, silicon oxynitride, as well as any other suitable selectively etchable material. The second insulating layer 14 substantially determines the gate 15 to focus ring 19 spacing (FIGS. 2 and 3).

Such an insulating layer 14, is not necessary to produce the embodiment of FIG. 2B, as the gate 15 functions both to extract and to collimate the electron stream in the embodiment.

The next process step (Step E of FIG. 8), a focus electrode layer 19 is deposited (FIG. 3). The focus rings 19 (FIG. 2) will be formed from the focus electrode layer 19. The focus electrode material layer 19 is also a conductive layer which may be comprised of a metal, such as chromium or molybdenum, but as in the case with the conductive gate material layer 15, the preferred material is doped polysilicon or silicided polysilicon.

At this stage in the fabrication, (Step E' of FIG. 8) a buffer material 21 may be deposited to prevent the undesired etching of the lower-lying portions of the focus electrode material layer 19 during the chemical mechanical polishing (CMP) step (Step F of FIG. 8) which follows. It should be emphasized that the deposition of a buffering layer 21 is an optional step.

A suitable buffering material includes a thin layer of $Si_3N_4$, or polyimide, or any other suitable buffering material known in the art. The nitride buffer layer 21 has the effect of enhancing the strength of the tip 13, which is one advantage of performing this optional step. The buffering layer 21 substantially impedes the progress of the CMP into the layer on which the buffering material 21 is deposited.

In the embodiment of FIG. 2B, the buffer layer 21 would be disposed on the conductive gate material layer 15.

The next step in the gate formation process (STEP F of FIG. 8) is the chemical mechanical planarization (CMP), also referred to in the art as chemical mechanical polishing (CMP). Through the use of chemical and abrasive techniques, the buffer material as well as any other layers (e.g. the peaks of the focus electrode layer 19, the conformal insulating layers 14, 18, and the conductive gate layer 15) extending beyond the emitter tip 13 are "polished" away.

In general, CMP involves holding or rotating a wafer of semiconductor material against a wetted polishing surface under controlled chemical slurry, pressure, and temperature conditions. A chemical slurry containing a polishing agent such as alumina or silica may be utilized as the abrasive medium. Additionally, the chemical slurry may contain chemical etchants. This procedure may be used to produce a surface with a desired endpoint or thickness, which also has a polished and planarized surface. Such apparatus for polishing are disclosed in U.S. Pat. Nos. 4,193,226 and 4,811,522. Another such apparatus is manufactured by Westech Engineering and is designated as a Model 372 Polisher.

CMP will be performed substantially over the entire wafer surface, and at a high pressure. Initially, CMP will proceed at a very fast rate, as the peaks are being removed, then the rate will slow dramatically after the peaks have been substantially removed. The removal rate of the CMP is proportionally related to the pressure and the hardness of the surface being planarized.

The level to which the layers are planarized is one factor determining the top of the gate 13 to cathode 15 spacing, especially with regard to the embodiment of FIG. 2B. FIG. 3B illustrates the various points to which the insulating layer 18 and the conductive layer 15 can be planarized the location of the gate structure of FIG. 2B.

Figure 4:
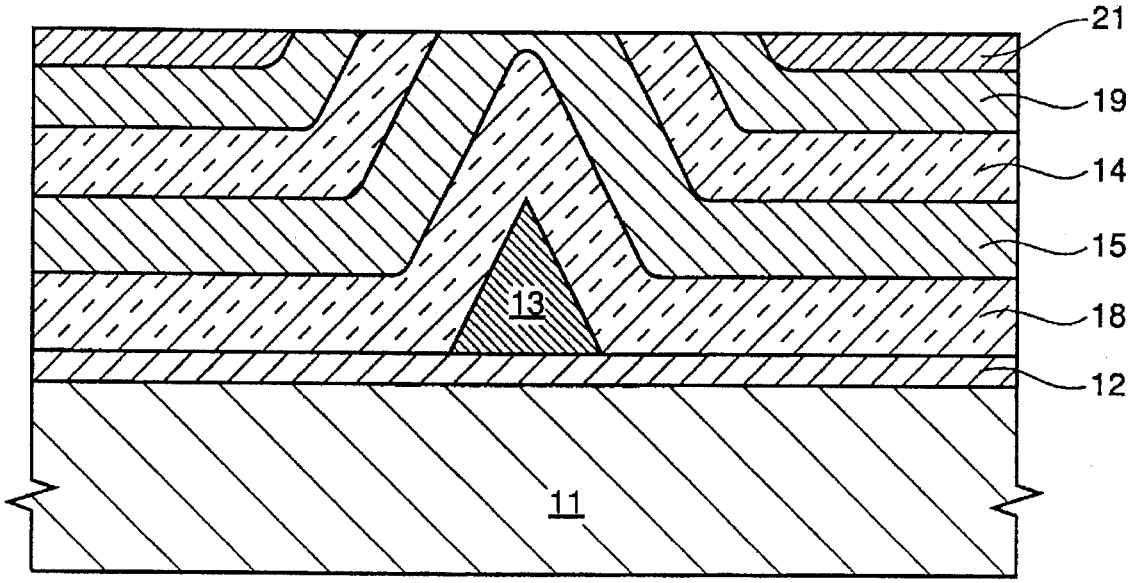
FIG. 4 shows the multi-layer structure of FIG. 3, after it has undergone chemical mechanical planarization (CMP), according to the present invention.

FIG. 4 illustrates the intermediate step in the gate 15 formation process following the chemical mechanical planarization CMP. A substantially planar achieve is achieved, and the second conformal insulating layer 14 is thereby exposed. At this point, (Step G of FIG. 8) the various layers can be selectively etched to expose the emitter tip 13 and define the self-aligned gate 15 and focus ring 19 structures using any of the various etching techniques known in the art, for example, a wet etch. As a result of the CMP process, the order of layer removal can also be varied.

Figure 5:
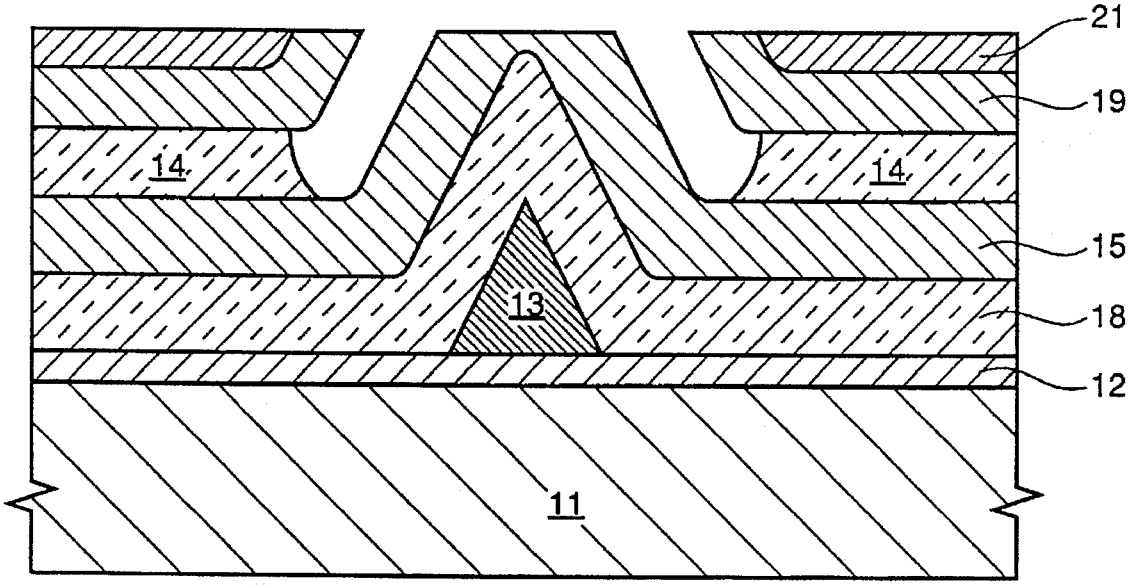
FIG. 5 shows the structure of FIG. 4, after a first etching, according to the present invention.

In the preferred embodiment, the second insulating layer 14 is selectively etched to expose the gate 15. FIG. 5 shows the means by which the second conformal insulating layer 14 defines the gate 15 to focus ring 19 spacing, as well as the means by which the gate 15 and the focus ring 19 become self-aligned.

Figure 6:
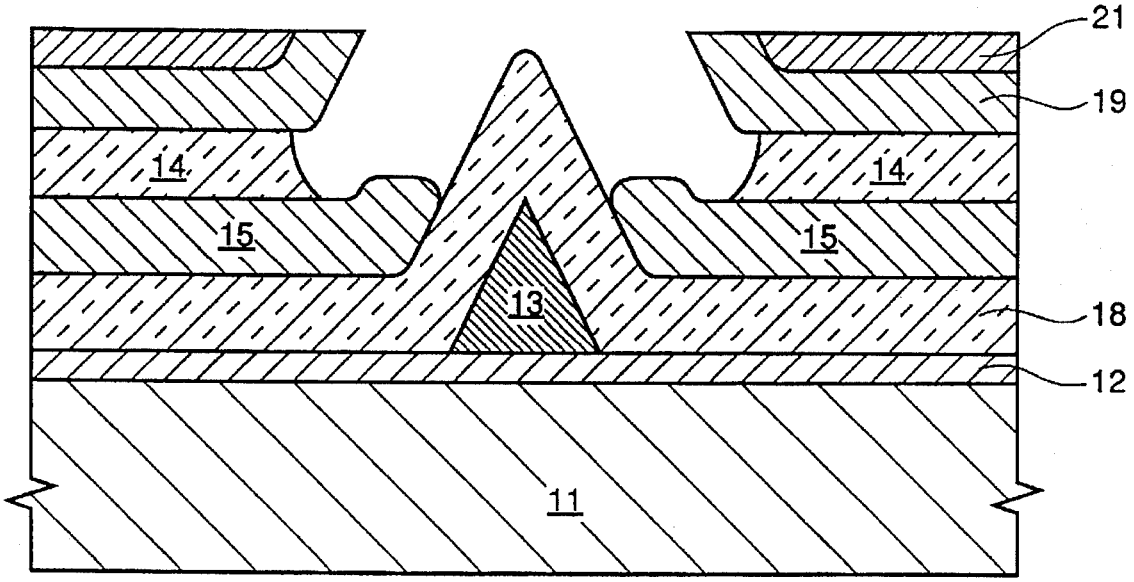
FIG. 6 shows the structure of FIG. 5, after a second etching, according to the present invention.

The gate material layer 15 is then etched, as shown in FIG. 6. After the gate material layer 15 is removed, the first conformal insulating layer 18, which covers the emitter tip 13, is exposed.

Figure 7:
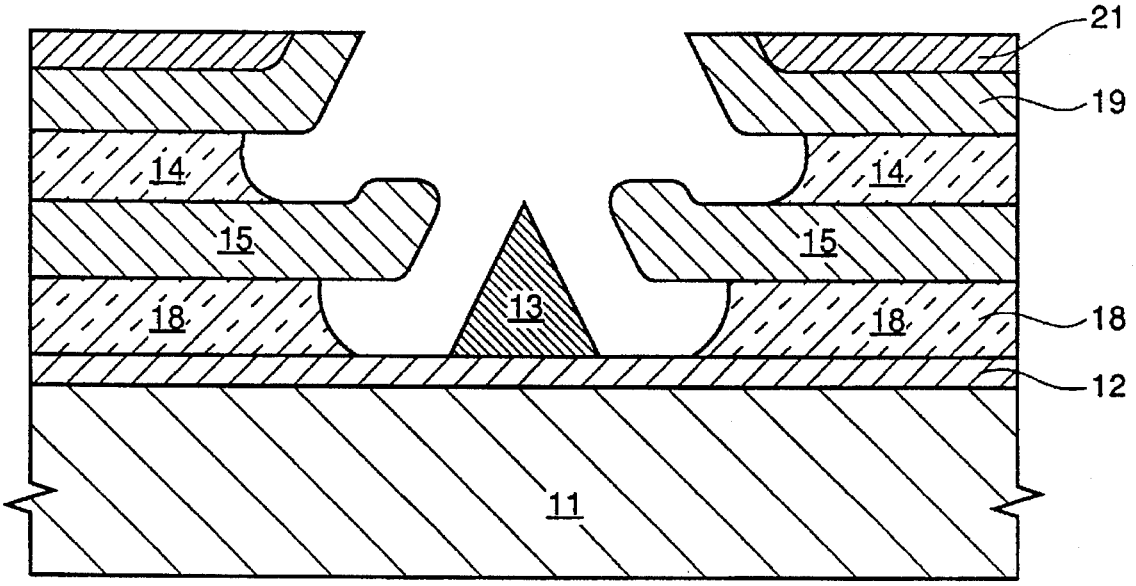
FIG. 7 shows the structure of FIG. 6, after etching, according to the present invention.

The next process step is a wet etching of the first selectively etchable insulating layer 18 to expose the emitter tip 13. FIG. 7 illustrates the field emitter device after the insulating cavity has been so etched.

In an alternative embodiment, (not shown), the gate material layer 15 can be removed first, thereby exposing the first insulating layer 18. Both of the selectively etchable insulating layers 14 and 18 can then be removed at the same time, thereby exposing the emitter tip 13.

After the CMP step, the embodiment of FIG. 2B requires the partial removal of insulating layer 18. However, since the insulating layer 14 and focus electrode layer 19 were not included in the embodiment of FIG. 2B, no steps for their removal are required.

If desired, the cathode tip 13 may optionally be coated with a low work function material (Step G' of FIG. 8). Low work function materials include, but are not limited to cermet ($Cr_3Si+SiO_2$), cesium, rubidium, tantalum nitride, barium, chromium silicide, titanium carbide, molybdenum, and niobium.

Coating of the emitter tips may be accomplished in one of many ways. The low work function material or its precursor may be deposited through sputtering or other suitable means on the tip 13. Certain metals (e.g., titanium or chromium) may be reacted with the silicon of the tip to form silicide during a rapid thermal processing (RTP) step. Following the RTP step, any unreacted metal is removed from the tip 13. In a nitrogen ambient, deposited tantalum may be converted during RTP to tantalum nitride, a material having a particularly low work function.

The coating process variations are almost endless. This results in an emitter tip 13 that may not only be sharper than a plain silicon tip, but that also has greater resistance to erosion and a lower work function. The silicide is formed by the reaction of the refractory metal with the underlying polysilicon by an anneal step.

Figure 3A:
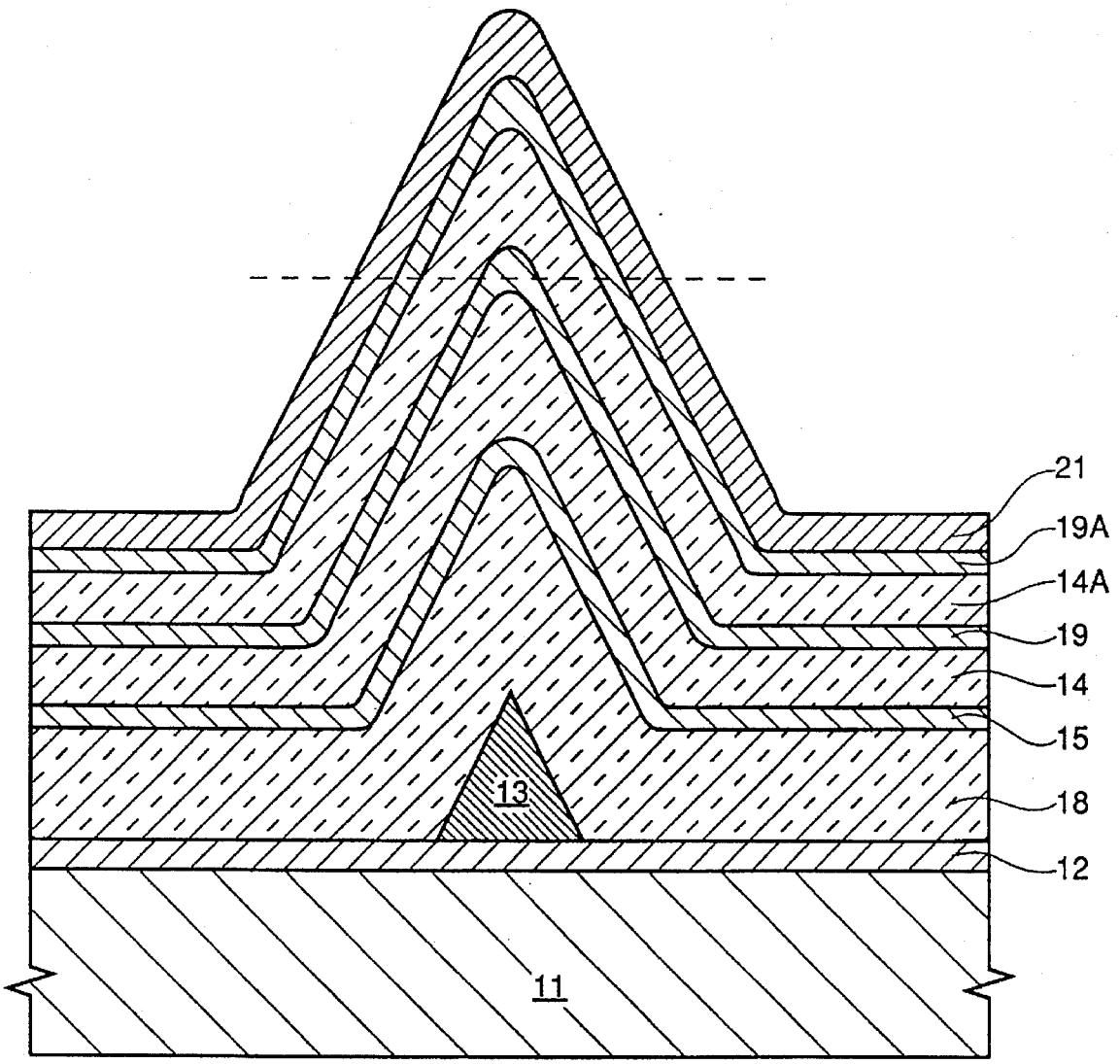
FIG. 3A shows the field emission cathode of FIG. 3, further illustrating multiple insulating layers and focus electrode layers.
Figure 3B:
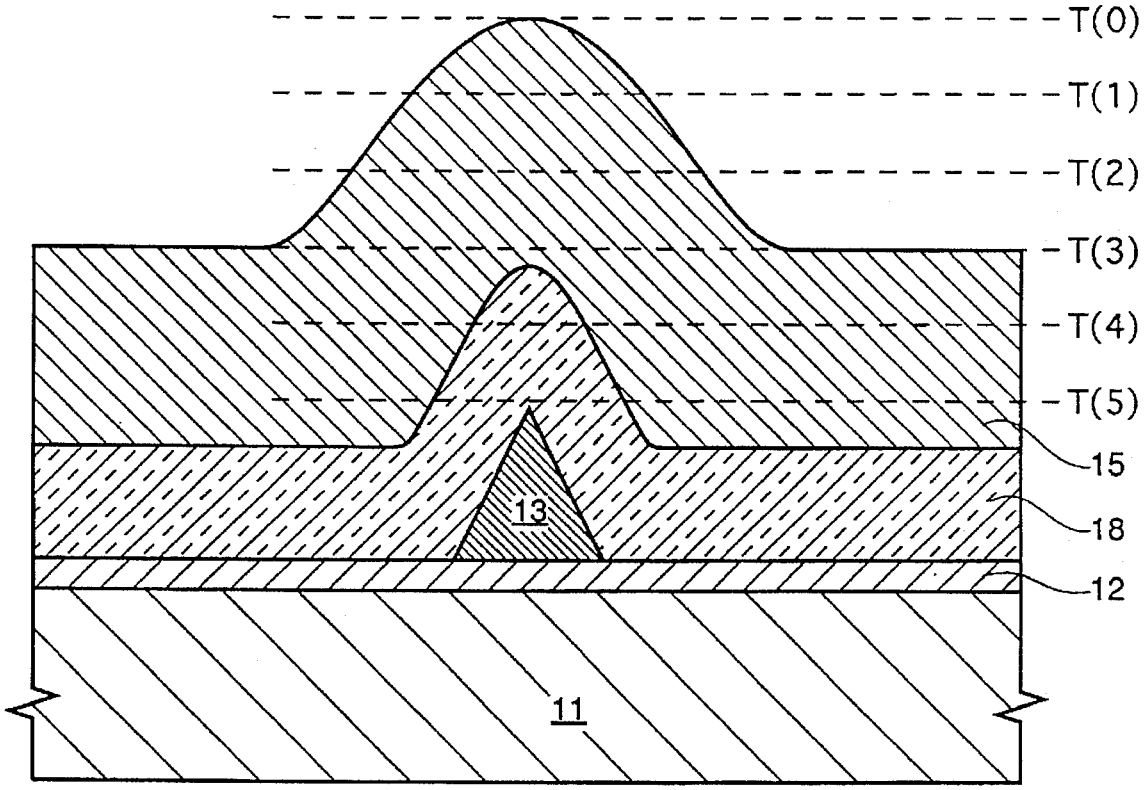
FIG. 3B shows a field emission cathode, having an emitter tip, on which has been deposited an insulating layer, and a conductive layer, further illustrating the various planarization levels for the embodiment of FIG. 2B.
Figure 7A:
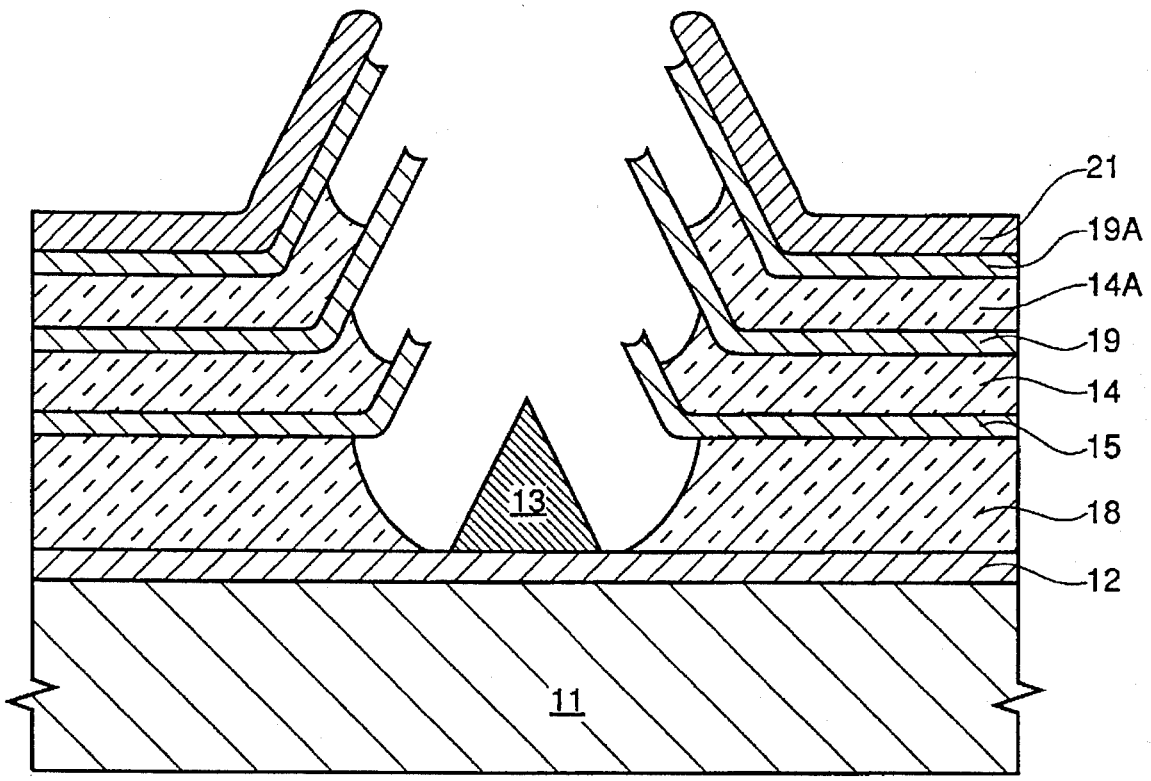
FIG. 7A shows the structure of FIG. 3A, after etching according to the present invention.

It is believed obvious to one skilled in the art that the manufacturing method described above is capable of considerable variation. For example, it is possible to fabricate several focus ring structures by adding successive insulating layers 14, 14*a*, etc., and conductive layers 19, 19*a*, etc. prior to the CMP step, (the relative level of the planarization step being indicated by the dotted line) and thereafter selectively etching the layers to expose the emitter tips 13, as shown in FIGS. 3A and 7A.

All of the U.S. Patents cited herein are hereby incorporated by reference herein as if set forth in their entirety.

While the particular process as herein shown and disclosed in detail is fully capable of obtaining the objects and advantages herein before stated, it is to be understood that it is merely illustrative of the presently understood embodiments of the invention and that no limitations are intended to the details of construction or design herein shown other than as described in the appended claims.

What is claimed is:

1. A method of forming a structure which intercepts a portion of an electron beam, comprising the steps of:

forming at least one emitter tip on a substrate, said emitter tip having an apex;

disposing an insulating layer over said emitter tip, said insulating layer having an upper surface at least as high as the height of said emitter tip apex;

disposing a conductive layer over said insulating layer;

planarizing said conductive layer; and selectively removing portions of said layers to form an opening in said layers, exposing said apex of said emitter tip.

2. The method according to claim 1, wherein said step of planarizing includes chemical mechanical polishing.

3. The method according to claim 1, wherein said conductive layer is generally parallel to said substrate.

4. The method according to claim 1, wherein said conductive layer is planar.

5. A method of forming a structure which intercepts a portion of an electron beam, said method comprising the steps of:

forming at least one emitter tip on a substrate, said emitter having an apex;

disposing an insulating layer over said emitter tip, said insulating layer having a thickness substantially equal to or greater than the height of said emitter tip;

disposing a conductive layer over said insulating layer, said conductive layer having a lower surface substantially level to or higher than said apex of said emitter tip, said conductive layer is disposed to pull electrons from said emitter tip when a voltage differential is created therebetween;

planarizing at least one of said layers; and selectively removing portions of said layers to form an opening in said layers, exposing said apex of said emitter tip.

6. A method of forming a structure which intercepts a portion of an electron beam, said method comprising the steps of:

forming at least one emitter tip on a substrate, said emitter having an apex;

disposing an insulating layer over said emitter tip, said insulating layer having a thickness substantially equal to or greater than the height of said emitter tip;

disposing a conductive layer over said insulating layer, said conductive layer having a lower surface substantially level to or higher than said apex of said emitter tip;

planarizing at least one of said layers; and selectively removing portions of said layers to form an opening in said layers, exposing said apex of said emitter tip, wherein said formed opening is conical and is spaced above said emitter tip.

7. A method of forming a field emission device, the method comprising the steps of:

providing a substrate wafer having at least one electron emitter supported thereon;

applying at least one insulating material layer over the substrate wafer and the emitter;

applying at least one conductive material layer over the insulating material layer, the conductive material layer located at a distance from said substrate at least equal to the height of the emitter tip; and removing a portion of at least said conductive material layer to create at least one gate aperture exposing at least a portion of said electron emitter.

8. The method of claim 7, wherein the removing step comprises the steps of:

planarizing a portion of at least one of said layers; and selectively removing exposed portions of said layers.

9. The method of claim 7, wherein each one of said layers is generally conformal to said electron emitters.

10. The method of claim 7, wherein the removing step includes removing portions of the conductive material layer, and etching away portions of the insulating material layer using said conductive material layer as an etching mask.

11. The method of claim 7, wherein said insulating material layer has a thickness at least equal to the height of said emitter.

12. The method of claim 7, further comprising the steps of:

overlaying a second insulating material layer over the conductive material layer;

overlaying a second conductive material layer over the additional insulating material layer; and removing a portion of at least the second conductive material layer to create at least one focus ring aperture.

13. The method of claim 12, further comprising the step of removing a portion of the additional insulating material layer generally intermediate the gate aperture and the focus ring aperture.

14. The method of claim 7, wherein each one of said layers is generally conformal to said emitter and the steps of applying said layers results in a layered peak overlying the emitter, and wherein the step of removing includes planarizing at least a portion of said layered peak.

15. The method of claim 14, wherein the removing step further includes the step of selectively removing additional portions of said insulating material layer.

* * * * *